US005927365A

United States Patent [19]

Almodovar et al.

[11] Patent Number: 5,927,365

[45] Date of Patent: Jul. 27, 1999

[54] MULTI-DIRECTIONAL WINDOW COVERING APPARATUS

[76] Inventors: Abad Almodovar; Gabriel Almodovar, both of 5009 W. Eddy, Chicago, Ill. 60641

[21] Appl. No.: 09/024,158

[22] Filed: Feb. 17, 1998

[51] Int. Cl.[6] ..... E06B 9/30

[52] U.S. Cl. ..... 160/168.1 R; 160/168.1 V; 160/173 V; 160/174 V; 160/177 V

[58] Field of Search ..... 160/115, 116, 160/128, 166.1 R, 168.1 V, 173 V, 174 V, 176.1 V, 176.1 R, 177 V, 180, 900

[56] References Cited

U.S. PATENT DOCUMENTS

| | | | |
|---|---|---|---|
| 916,752 | 3/1909 | Mitchell | 160/115 |
| 2,386,695 | 10/1945 | Lister-Torsen | 160/172 V |
| 3,086,584 | 4/1963 | Houmere | 160/168.1 V |
| 3,467,164 | 9/1969 | Olsson | 160/188 |
| 3,862,655 | 1/1975 | Knapper | 160/172 V |
| 4,657,061 | 4/1987 | Meier | 160/176 R |
| 4,739,816 | 4/1988 | Dodich et al. | 160/168.1 R |
| 4,936,370 | 6/1990 | Uecker et al. | 160/168.1 |
| 4,984,617 | 1/1991 | Corey | 160/84.1 |
| 5,042,553 | 8/1991 | Schaffer et al. | 160/178.1 |
| 5,050,662 | 9/1991 | Kellener | 160/168.1 |
| 5,054,534 | 10/1991 | Hong | 160/84.1 |
| 5,121,783 | 6/1992 | Nilsson | 160/89 |
| 5,139,071 | 8/1992 | Danchulis | 160/115 |
| 5,197,526 | 3/1993 | Schon | 160/84.1 |
| 5,443,108 | 8/1995 | LeVert et al. | 160/167 R |
| 5,462,105 | 10/1995 | Supernak | 160/323.1 |
| 5,524,690 | 6/1996 | Bortoloso et al. | 160/128 |
| 5,680,891 | 10/1997 | Prince | 160/84.05 |

*Primary Examiner*—Daniel P. Stodola
*Assistant Examiner*—Bruce A. Lev
*Attorney, Agent, or Firm*—David L. Volk

[57] ABSTRACT

A first track assembly is adapted to be mounted to a top of a window opening. A plurality of first cord support assemblies are slidably mounted within the first track assembly. A plurality of second cord support assemblies are slidably mounted within a second track assembly. A plurality of columns of panels is provided, each column being strung between a pair of the first and the second cord support assemblies. A vertical opening and closing mechanism is provided for pulling the second track assembly toward the first track assembly and for lowering the second track assembly away from the first track assembly, thus collapsing and extending each column of panels. A horizontal opening and closing mechanism is provided for simultaneously drawing the first support assemblies together and drawing the second support assemblies together, and for simultaneously separating at pre-determined equal distances the first support assemblies and separating at pre-determined equal distances the second support assemblies, thus drawing the columns of panels together and separating the columns of panels. A vertical pivoting mechanism is provided for pivoting all of the panels simultaneously about a horizontal axis of each panel. A horizontal pivoting mechanism is provided for pivoting all of the panels simultaneously about a vertical axis of each panel.

2 Claims, 10 Drawing Sheets

MULTI-DIRECTIONAL WINDOW COVERING APPARATUS

BACKGROUND OF THE INVENTION

1. Field of the Invention

The present invention relates to window coverings, particularly to blinds which utilize pulley systems to open and close.

2. Description of the Related Art

As is well known in the art, numerous window coverings are in general use throughout the world. In addition to many varieties of drapes and pull shades, blind type window coverings are also known and in wide use. By providing a means to adjust the amount of light entering into a window (or the amount of privacy provided), blinds provide a versatile window covering. Problems can occur, however, in the manner in which conventional blinds control the entrance of light. A blind with the arrangements of horizontal slats may be particularly well suited for an east or west facing window, or a window which opens in the vertical direction, but may not be particularly well suited for a north or south facing window, or for a window or door which opens in the horizontal direction, such as casement type windows or sliding glass doors, for example.

Numerous attempts have been made to correct for the foregoing problems. Such attempts have invariably resulted in a blind having vertically elongated slats which open in a horizontal direction. Such a solution, however, merely provides an equal level of specialization, thereby substituting nearly identical problems and providing no greater level of diversity. Users are invariably left with an option of utilizing all horizontal type blinds, all vertical type blinds, or mixing between the two and inevitably causing aesthetic difficulties during decorating of a living space.

Consequently, a need has been felt for providing an apparatus which can decoratively cover a window opening, while providing at the same time the benefits of both horizontal type blinds and vertical type blinds.

SUMMARY OF THE INVENTION

The multi-directional window covering apparatus of the present invention includes a first track assembly adapted to be mounted to a top of a window opening. A plurality of first cord support assemblies are slidably mounted within the first track assembly. A plurality of second cord support assemblies are slidably mounted within a second track assembly.

A plurality of columns of panels is provided, each column being strung between a pair of the first and the second cord support assemblies. A vertical opening and closing mechanism is provided for pulling the second track assembly toward the first track assembly and for lowering the second track assembly away from the first track assembly, thus collapsing and extending each column of panels.

A horizontal opening and closing mechanism is provided for simultaneously drawing the first support assemblies together and drawing the second support assemblies together, and for simultaneously separating at pre-determined equal distances the first support assemblies and separating at pre-determined equal distances the second support assemblies, thus drawing the columns of panels together and separating the columns of panels.

A vertical pivoting mechanism is provided for pivoting all of the panels simultaneously about a horizontal axis of each panel. A horizontal pivoting mechanism is provided for pivoting all of the panels simultaneously about a vertical axis of each panel.

The apparatus of the present invention thus may open and close in both horizontal and vertical directions, and the panels are simultaneously pivotal in both horizontal and vertical directions, thus providing an extremely versatile window covering system.

Still further features and advantages will become apparent from the ensuing description and drawings.

DETAILED DESCRIPTION

Figure 1:
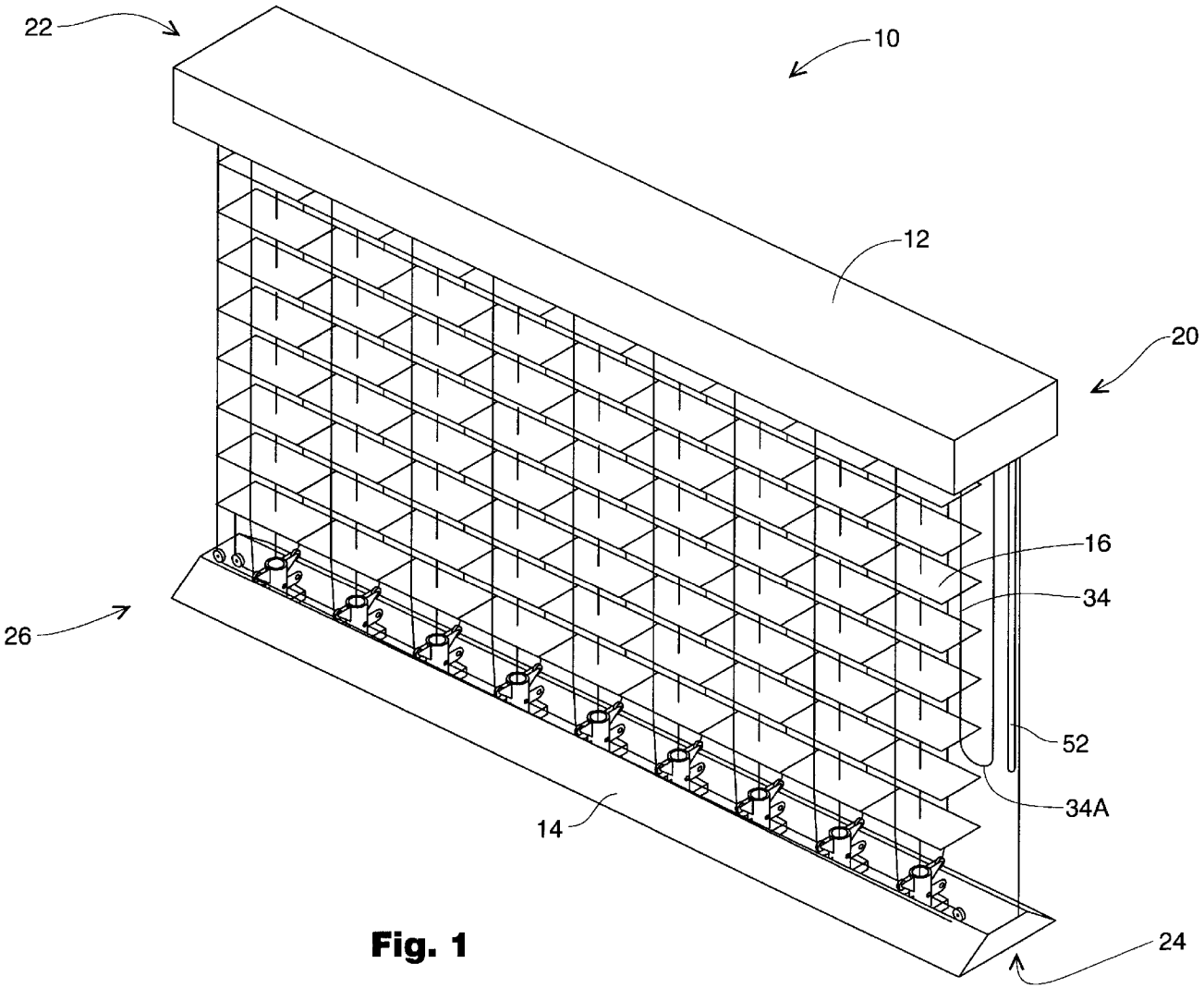
FIG. 1 is a perspective view of a window covering apparatus of the present invention.

FIG. 1 is a perspective view of a window covering apparatus 10 of the present invention. The apparatus 10 includes a stationary track assembly 12 and a movable track assembly 14. The stationary track assembly 12 is mountable to the top of a window opening or glass door opening (not shown) in a conventional manner. A plurality of panels 16 are arranged in columns and rows, and are strung between the stationary track assembly 12 and the movable track assembly 14.

Figure 2:
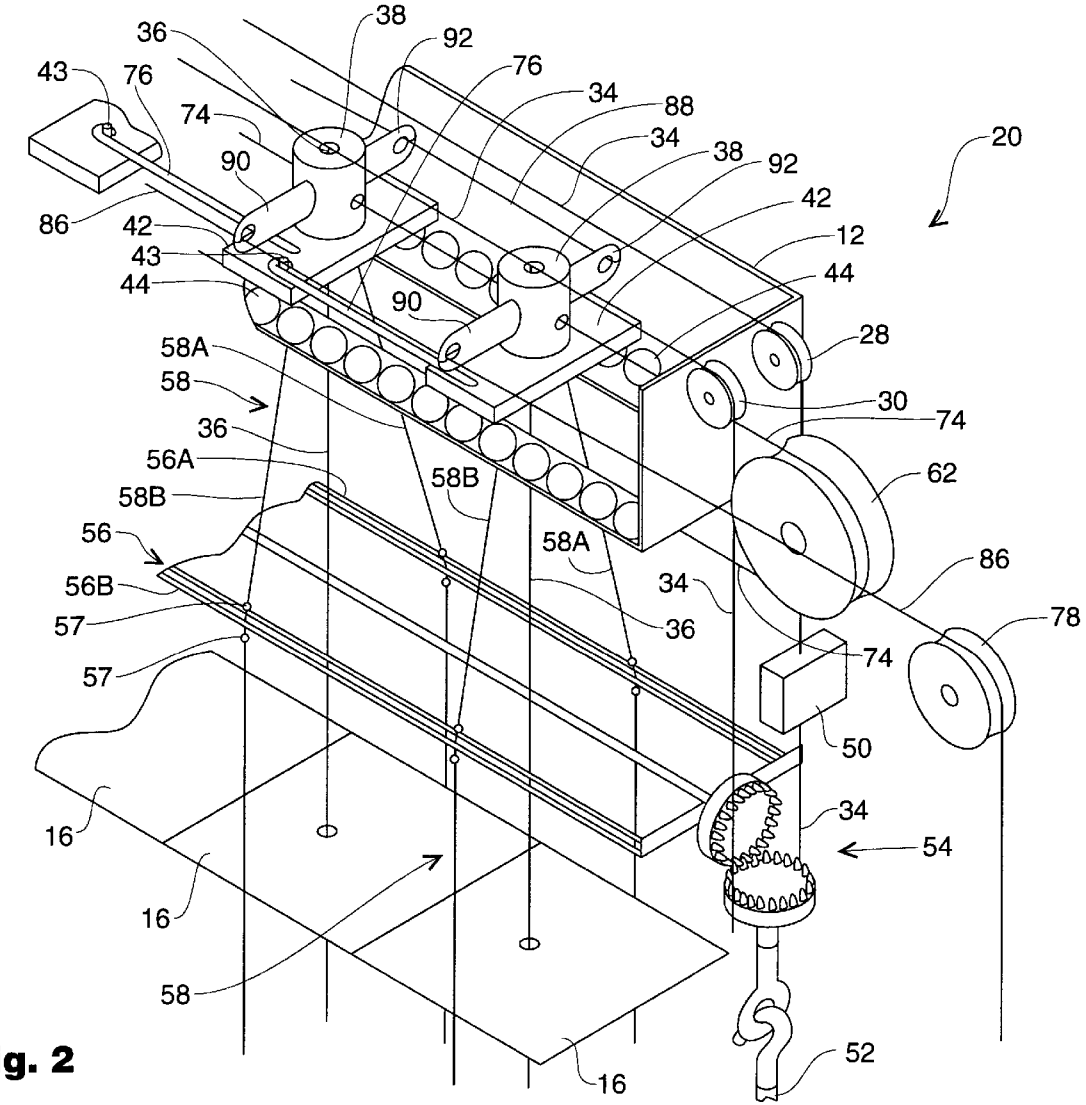
FIG. 2 is a partial enlarged perspective view of a first corner portion of the apparatus.

FIG. 2 is a partial enlarged perspective view of a first corner portion 20 of the apparatus 10. Portions of the stationary track assembly 12 are not shown for clarity and ease of illustration. Referring to FIG. 1, the element designation 20 shows in particular which portion of the apparatus 10 is being shown in FIG. 2. A first vertical adjustment pulley 28 and a second vertical adjustment pulley 30 are provided. These pulleys 28, 30 are connected in any conventional manner to the stationary track assembly 12. The connections are not shown for ease of illustration.

Figure 3:
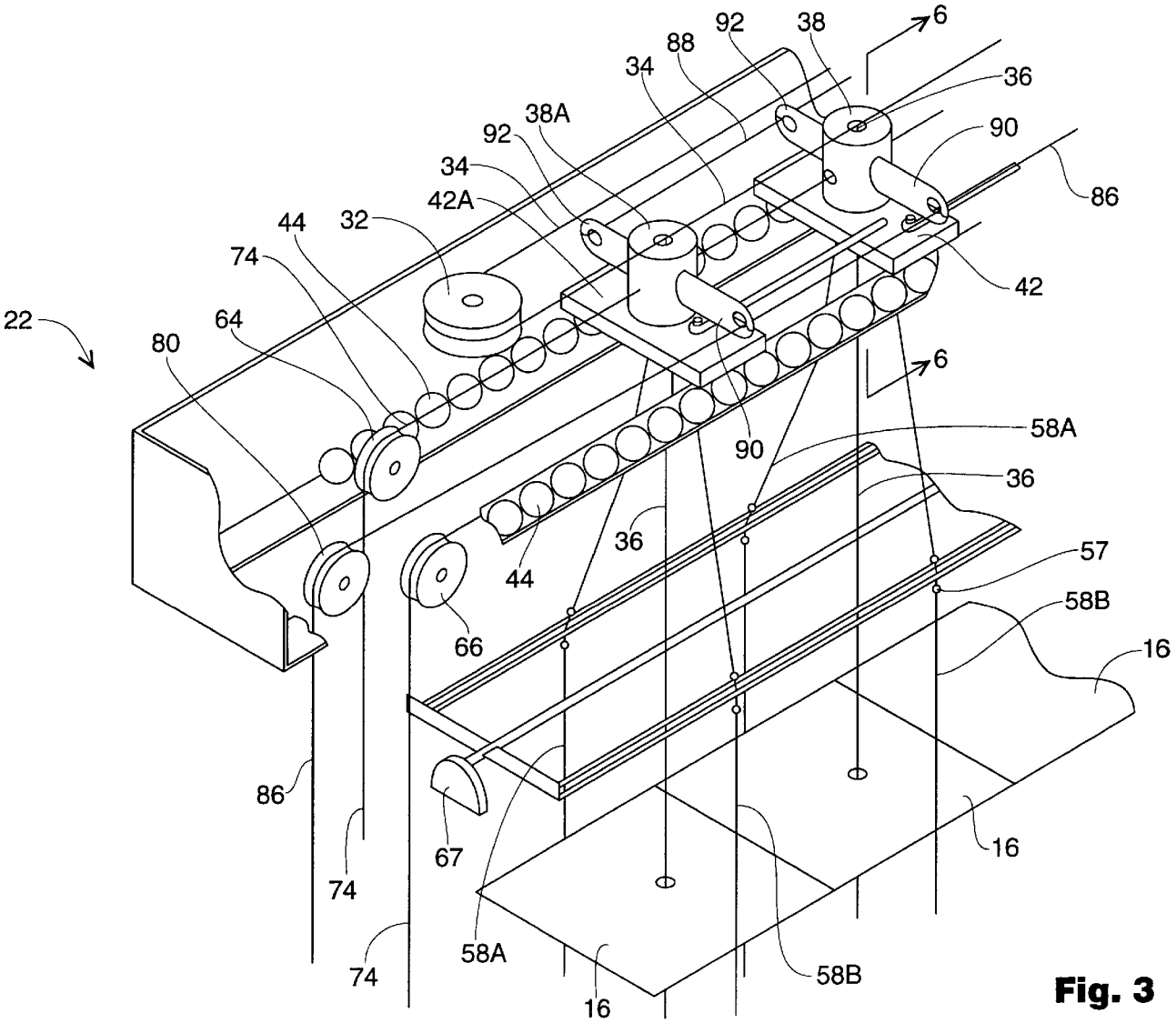
FIG. 3 is a partial enlarged perspective view of a second corner portion of the apparatus.

FIG. 3 is a partial enlarged perspective view of a second corner portion 22 of the apparatus 10. Portions of the stationary track assembly 12 are not shown for clarity and ease of illustration. Referring to FIG. 1, the element designation 22 shows in particular which portion of the apparatus 10 is being shown in FIG. 3. A third vertical adjustment pulley 32 is connected in any conventional manner to the stationary track assembly 12. The connections are not shown for ease of illustration. A vertical adjustment cord 34 runs along the first vertical adjustment pulley 28, then along the stationary track assembly 12, then around the third vertical adjustment pulley 32, then back along the stationary track assembly 12, then along the second vertical adjustment pulley 30. The cord 34 hangs downward from the first and second pulleys 28, 30 to form a loop 34A, as shown in FIG. 1. A series of central cords 36 are connected to the vertical adjustment cord 34 at regular intervals along the vertical adjustment cord 34. The central cords 36 each extend downward through a first spool member 38. Each of the central cords 36 extends downward through centers of the panels 16. The central cords 36 are not fixedly connected to any of the panels, but rather are slidable through the panels 16.

Figure 4:
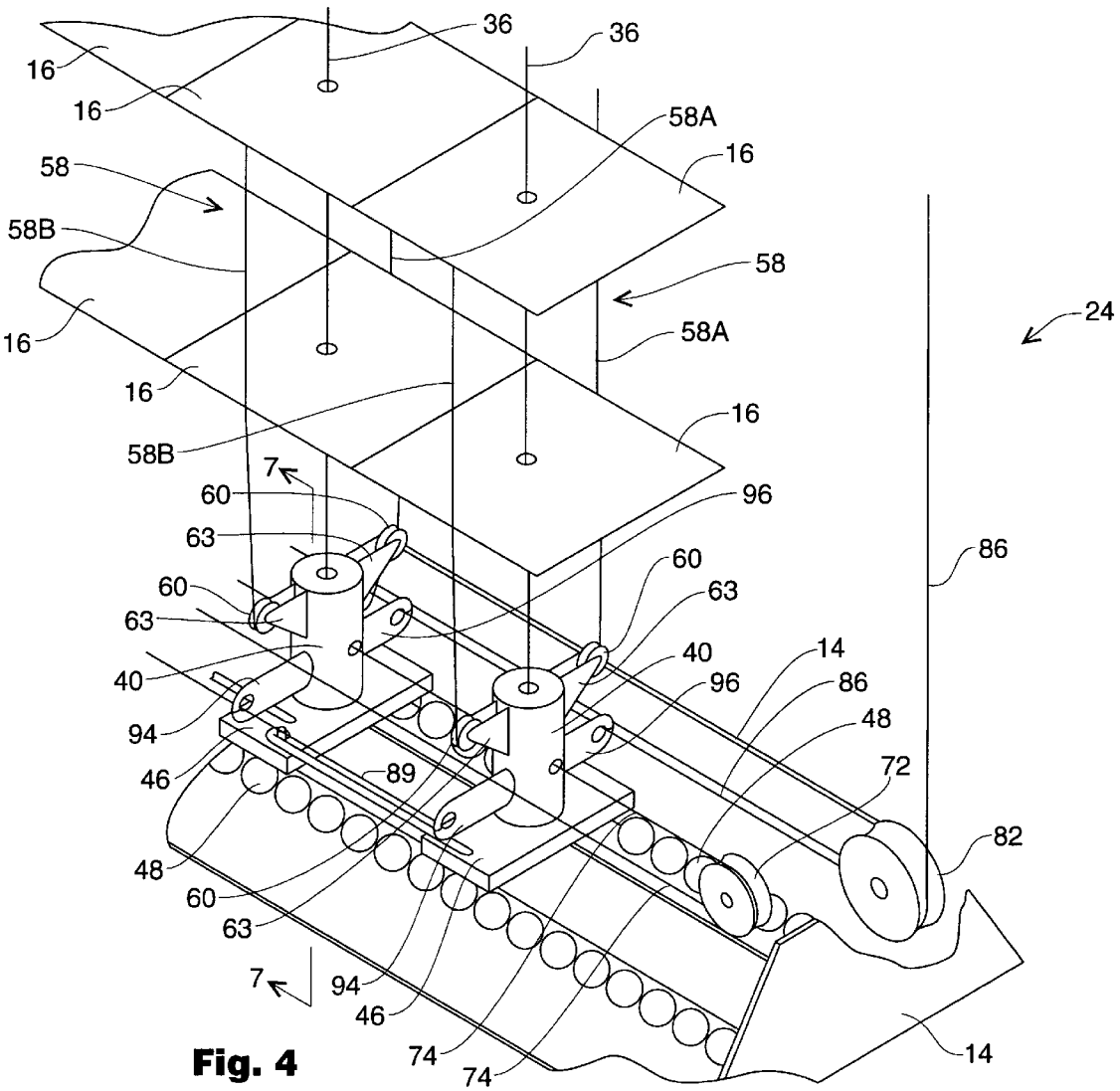
FIG. 4 is a partial enlarged perspective view of a third corner portion of the apparatus.
Figure 5:
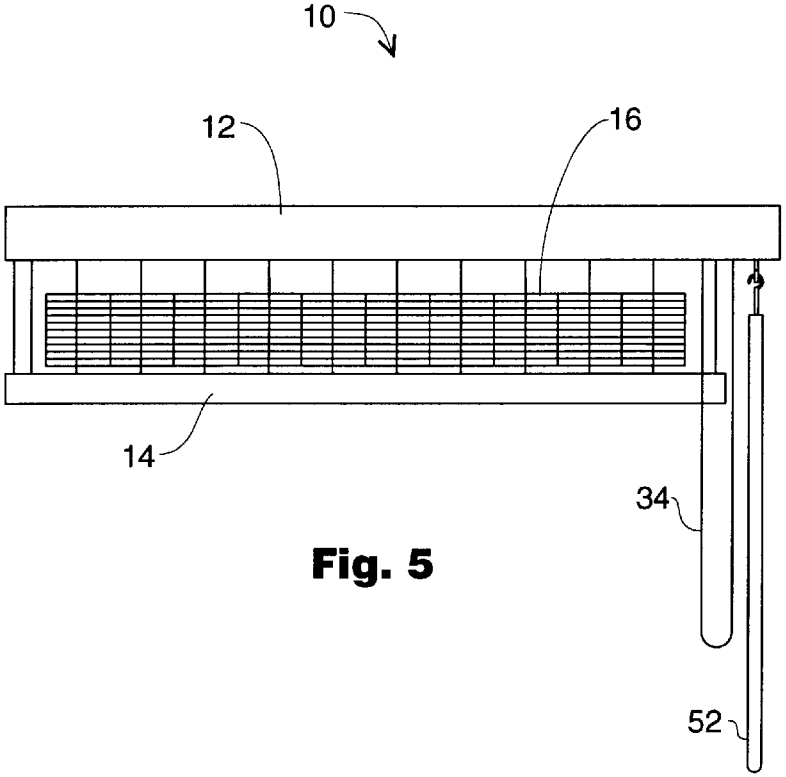
FIG. 5 is an elevational view of the apparatus in the vertically closed position.

FIG. 4 is a partial enlarged perspective view of a third corner portion 24 of the apparatus 10. Portions of the movable track assembly 14 are not shown for clarity and ease of illustration. Referring to FIG. 1, the element designation 24 shows in particular which portion of the apparatus 10 is being shown in FIG. 4. The central cords 36 are each connected to a second spool member 40. As will be described later herein, the second spool members 40 are retained within the movable track assembly 14 such that when the second spool members 40 are raised by an upward movement of the central cords 36, the movable track assembly 14 is lifted upward. The movable track assembly 14 thus pushes against the panels 16 and the apparatus 10 closes in the vertical direction. FIG. 5 is an elevational view of the apparatus 10 in the vertically closed position. The movable track assembly 14 is raised or lowered by pulling on the appropriate side of the vertical adjustment cord 34 above the loop 34A (FIG. 1). This causes the central cord 36 to be raised or lowered as appropriate, thus raising or lowering the movable track assembly 14.

Referring to FIG. 2, a conventional locking mechanism 50 as is known in the art of blind type window coverings, locks the vertical adjustment cord 34 in position when the movable track assembly 14 is partially or fully raised. As is known in the art, the user engages the vertical adjustment cord 34 in the locking mechanism 50 by pulling sideways on the vertical adjustment cord 34.

Figure 6:
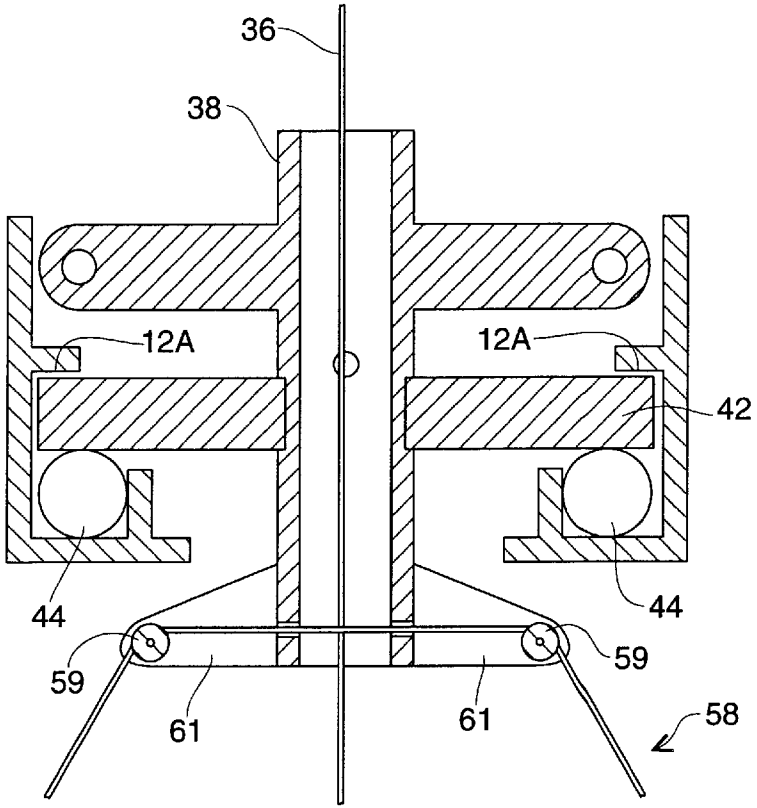
FIG. 6 is a cross-sectional view of the first spool member taken along line 6—6 of FIG. 3.

FIG. 6 is a cross-sectional view of the first spool member 38 taken along line 6—6 of FIG. 3. Referring to FIGS. 3 and 6, the first spool member 38 is mounted within a first platform 42 such that the first spool member 38 is freely rotatable about a central longitudinal axis thereof. The first platform 42 is mounted on a pair of first bearing assemblies 44 such that the first platform 42 is slidable within the stationary track assembly 12. An inwardly turned lip 12A of the stationary track assembly 12 restrains the first platform 42 from upward movement out of the stationary track assembly 12. The central cord 36 extends downward through the first spool member 38.

Figure 7:
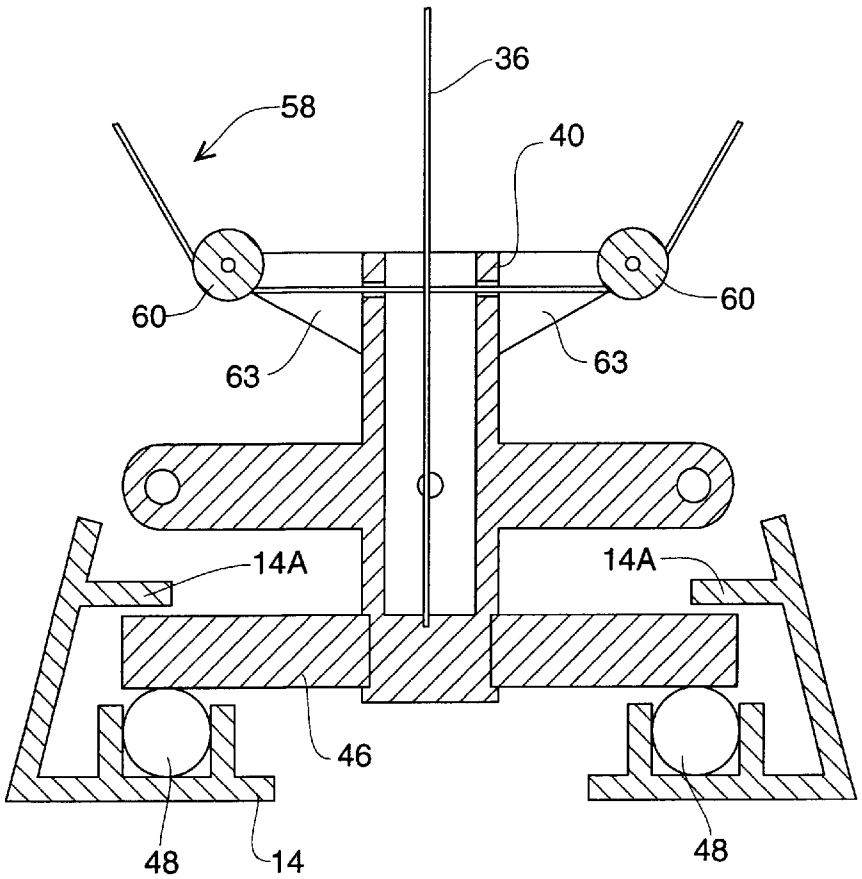
FIG. 7 is a cross-sectional view of the second spool member taken along line 7—7 of FIG. 4.

FIG. 7 is a cross-sectional view of the second spool member 40 taken along line 7—7 of FIG. 4. Referring to FIGS. 4 and 7, the second spool member 40 is mounted within a second platform 46 such that the second spool member 40 is freely rotatable about a central longitudinal axis thereof. The second platform 46 is mounted on a pair of second bearing assemblies 48 such that the second platform 46 is slidable within the movable track assembly 14. An inwardly turned lip 14A of the movable track assembly 14 restrains the second platform 46 from upward movement out of the movable track assembly 14. The central cord 36 extends downward from the first spool member 38, and connects to the second spool member 40.

Referring primarily to FIGS. 1 and 2, a wand 52 is configured to advance a gear mechanism 54, which in turn pivots a frame 56 situated above the panels 16. Referring to FIG. 3, the frame 56 is pivotally mounted within a mounting member 67. The mounting member 67 is connected to the stationary track assembly in any conventional manner. The connection is not shown for ease of illustration.

Referring to FIGS. 2, 4, 6 and 7, a vertical pivot cord 58 is provided for each column of the panels 16. The vertical pivot cord 58 runs through top pivot pulleys 59 attached to each first spool member 38, and through bottom pivot pulleys 60 to form a loop having an inner cord portion 58A and an outer cord portion 58B. The top pivot pulleys 59 are positioned at distal ends of pulley legs 61 which extend outward from opposing sides of each of the first spool members 38. In a like manner, the bottom pivot pulleys 60 are positioned at distal ends of pulley arms 63 which extend outward from opposing sides of each of the second spool members 40.

The inner and outer cord portions 58A, 58B are attached to opposing sides of the panels 16.

The frame 56 comprises a pair of parallel inner frame members 56A and a pair of parallel outer frame members 56B. The inner cord portions 58A extend between the inner frame members 56A and the outer cord portions 58B extend between the outer frame members 56B. The inner cord portions 58A and the outer cord portions 58B each include stop members 57 attached thereto, above and below the frame members 56A, 56B.

Figure 8:
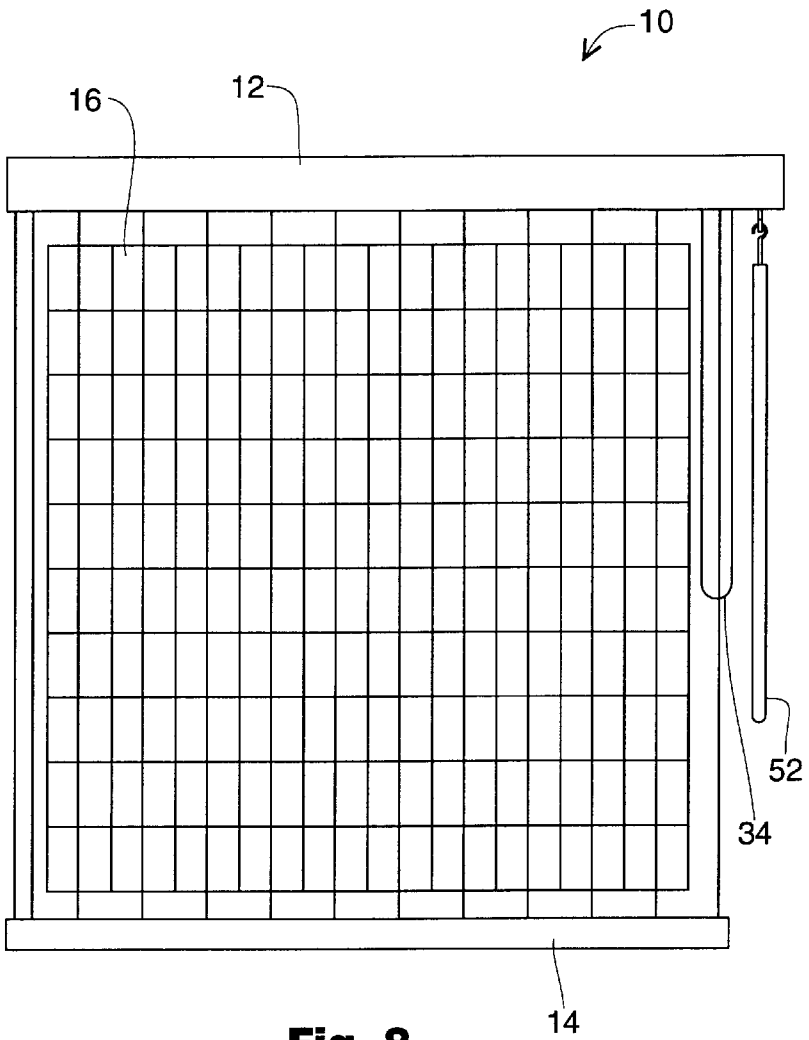
FIG. 8 is an elevational view of the apparatus showing the panels adjusted by the wand to a vertical orientation.
Figure 9:
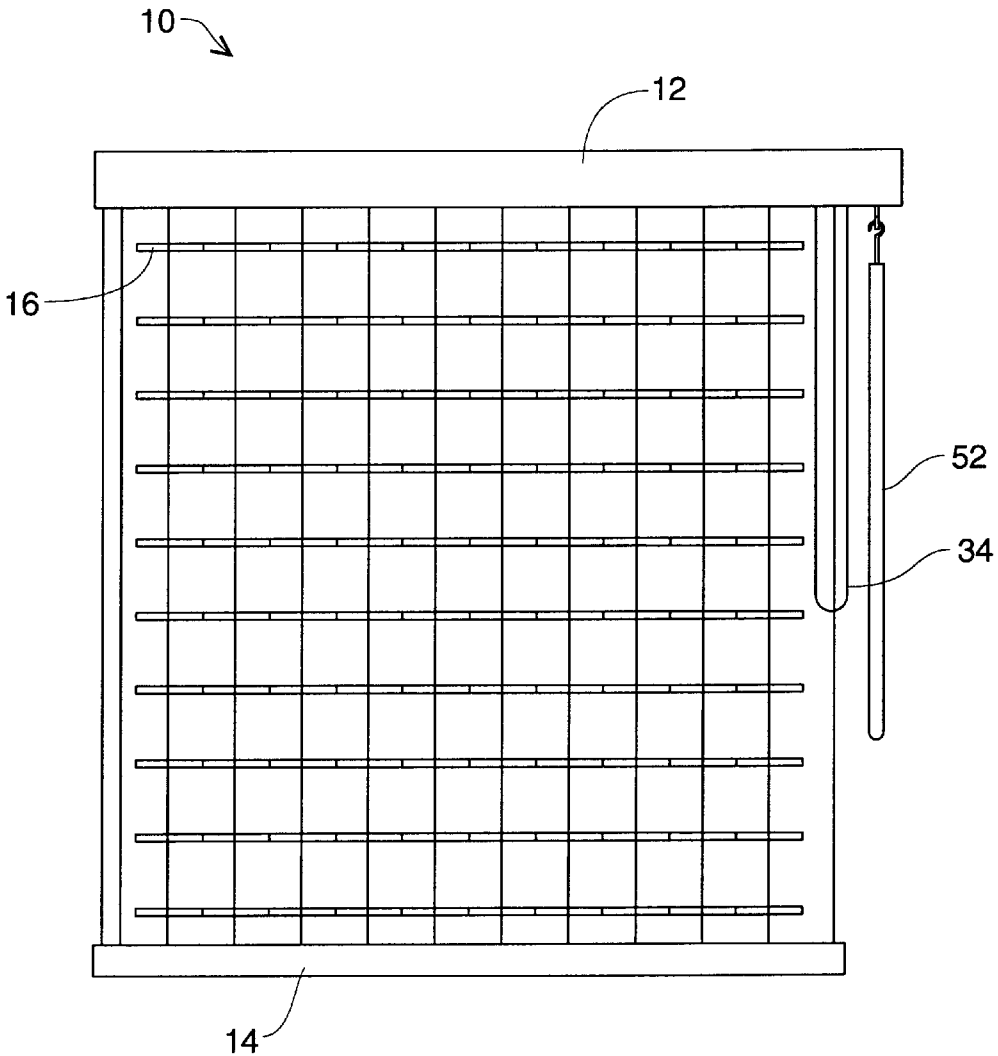
FIG. 9 is an elevational view of the apparatus showing the panels adjusted by the wand to a horizontal orientation.

When a user rotates the wand 52, the gear mechanism 54 advances, pivoting the frame 56, thus urging against the stop members 57 to raise or lower the outer cord portion 58B relative to the inner cord portion 58A, thus providing horizontal adjustment of the panels 16. FIG. 8 is an elevational view of the apparatus 10 showing the panels 16 adjusted by the wand 52 to a vertical orientation. FIG. 9 is an elevational view of the apparatus 10 showing the panels 16 adjusted by the wand 52 to a horizontal orientation.

Referring to FIG. 2, a first horizontal adjustment pulley 62 is connected in any conventional manner to the stationary track assembly 12. The connections are not shown for ease of illustration. Referring to FIG. 3, a second horizontal adjustment pulley 64 and a third horizontal adjustment pulley 66 are each connected in any conventional manner to the stationary track assembly 12. The connections are not shown for ease of illustration.

Figure 10:
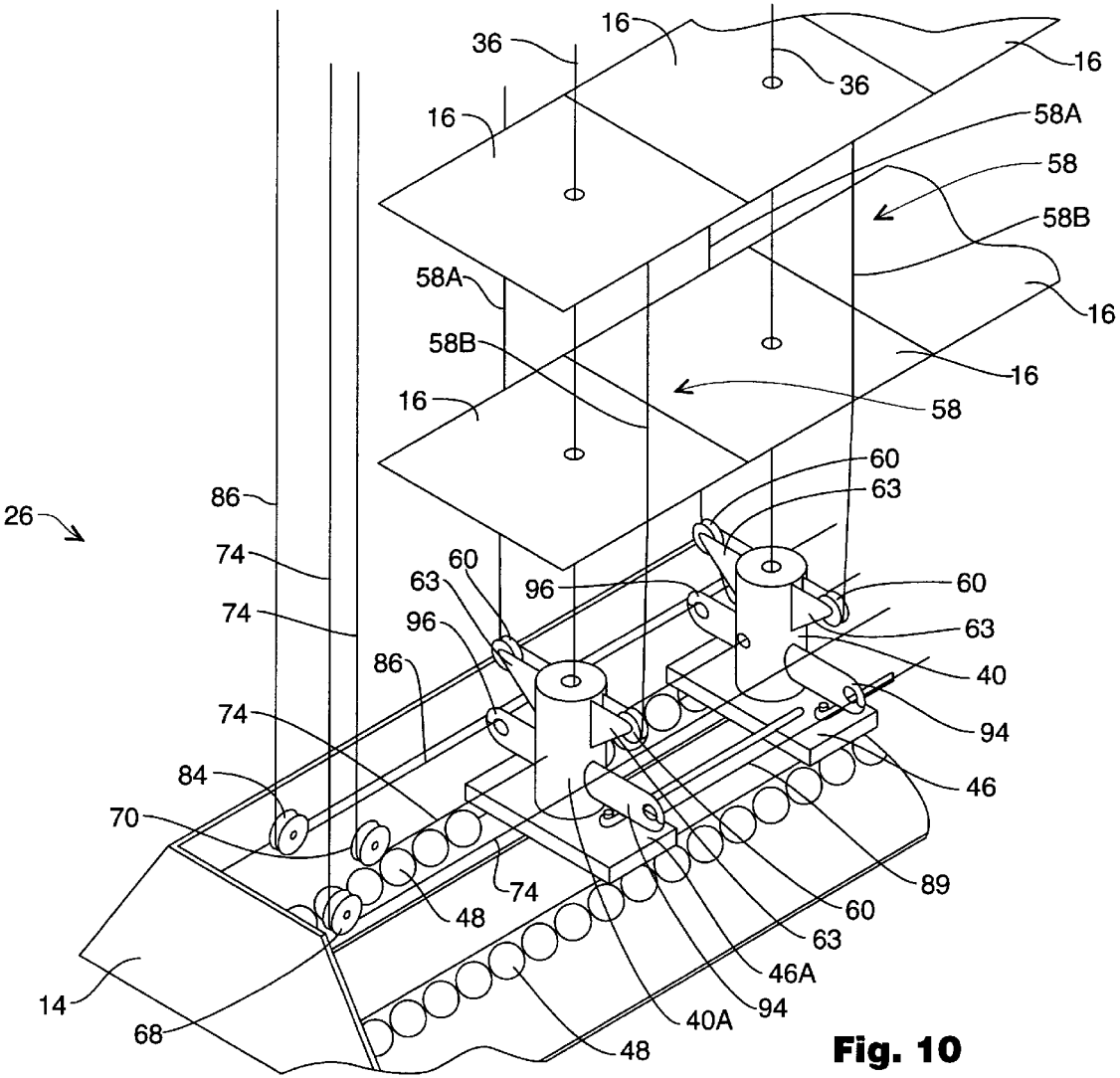
FIG. 10 is a partial enlarged perspective view of a fourth corner portion of the apparatus.

FIG. 10 is a partial enlarged perspective view of a fourth corner portion 26 of the apparatus 10. Portions of the movable track assembly 14 are not shown for clarity and ease of illustration. Referring to FIG. 1, the element designation 26 shows in particular which portion of the apparatus 10 is being shown in FIG. 10. A fourth horizontal adjustment pulley 68 and a fifth horizontal adjustment pulley 70 are connected in any conventional manner to the movable track assembly 14. The connections are not shown for ease of illustration.

Referring to FIG. 4, a sixth horizontal adjustment pulley 72 is connected in any conventional manner to the movable track assembly 14. The connections are not shown for ease of illustration.

Referring to FIGS. 2, 3, 4 and 10, a horizontal adjustment cord 74 is looped around the first horizontal adjustment pulley 62. The horizontal adjustment cord 74 extends from the first horizontal adjustment pulley 62, through the first spool members 38 along the stationary track assembly 12, then around the second horizontal adjustment pulley 64, then down to the movable track assembly 14 and around the fourth horizontal adjustment pulley 68, then along the movable track assembly 14 and around the sixth horizontal adjustment pulley 72, then back along the movable track assembly 14 through the second spool members 40, then around the fifth horizontal adjustment pulley 70, then up to the stationary track assembly 12 and around the third horizontal adjustment pulley 66, than along the stationary track assembly 12 and around the first horizontal adjustment pulley 62.

Referring to FIGS. 3 and 10, the horizontal adjustment cord 74 is connected to a leading first spool member 38A, and is also connected to a leading second spool member 40A. When the portion of the horizontal adjustment cord 74 which runs downward from the second horizontal adjustment pulley 64 is pulled downward, the leading first spool member 38A is pulled toward the second horizontal adjustment pulley 64, and the leading second spool member 40A is pulled toward the fifth horizontal adjustment pulley 70.

Each of the first platforms 42 except for a leading first platform 42A, includes a grabbing arm 76 attached to the first platform 42 and extending in the direction of the leading first platform 42A. Each of the second platforms 46 except for a leading second platform 46A, also includes a grabbing arm 76 attached to the second platform 46 and extending in the direction of the leading second platform 46A. Each grabbing arm 76 is turned at a distal end thereof to grab a peg 43 protruding upwardly from the platform 42, 46 adjacent thereto.

Figure 11:
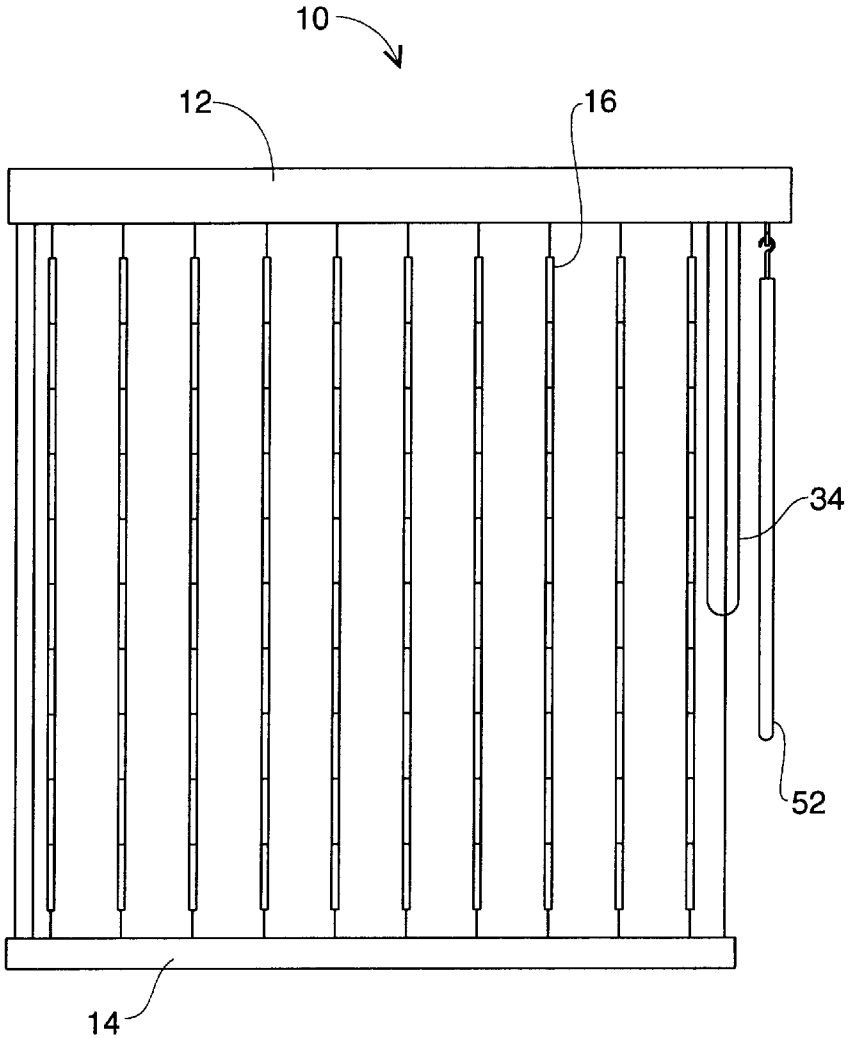
FIG. 11 is an elevational view of the window covering apparatus in the horizontally closed position.

When the leading first spool member 38A is drawn by the horizontal adjustment cord 34 toward the second horizontal adjustment pulley 64, the peg 43 of the leading first platform 42A urges against the distal end of the grabbing arm 76 of the adjacent first platform 42, thus pulling the adjacent first platform 42 along in the direction of movement of the leading first platform 42A. In a like manner, the peg 43 of each first platform 42 in line grabs the distal end of the grabbing arm 76 of the adjacent first platform 42; thus, all of the first spool members 38 and the first platforms 42 are pulled toward the second horizontal adjustment pulley 64, and the window covering apparatus 10 is thus horizontally closed. FIG. 11 is an elevational view of the window covering apparatus 10 in this horizontally closed position.

When the leading second spool member 40A is drawn by the horizontal adjustment cord 34 toward the fifth horizontal adjustment pulley 70, the peg 43 of the leading second platform 46A urges against the distal end of the grabbing arm 76 of the adjacent second platform 46, thus pulling the adjacent second platform 46 along in the direction of movement of the leading second platform 46A. In a like manner, the peg 43 of each second platform 46 in line grabs the distal end of the grabbing arm 76 of the adjacent second platform 46; thus all of the second spool members 40 and the second platforms 46 are pulled toward the fifth horizontal adjustment pulley 70. The first and the second spool members 38, 40 are thus drawn simultaneously toward the horizontally closed position shown in FIG. 11.

Figure 12:
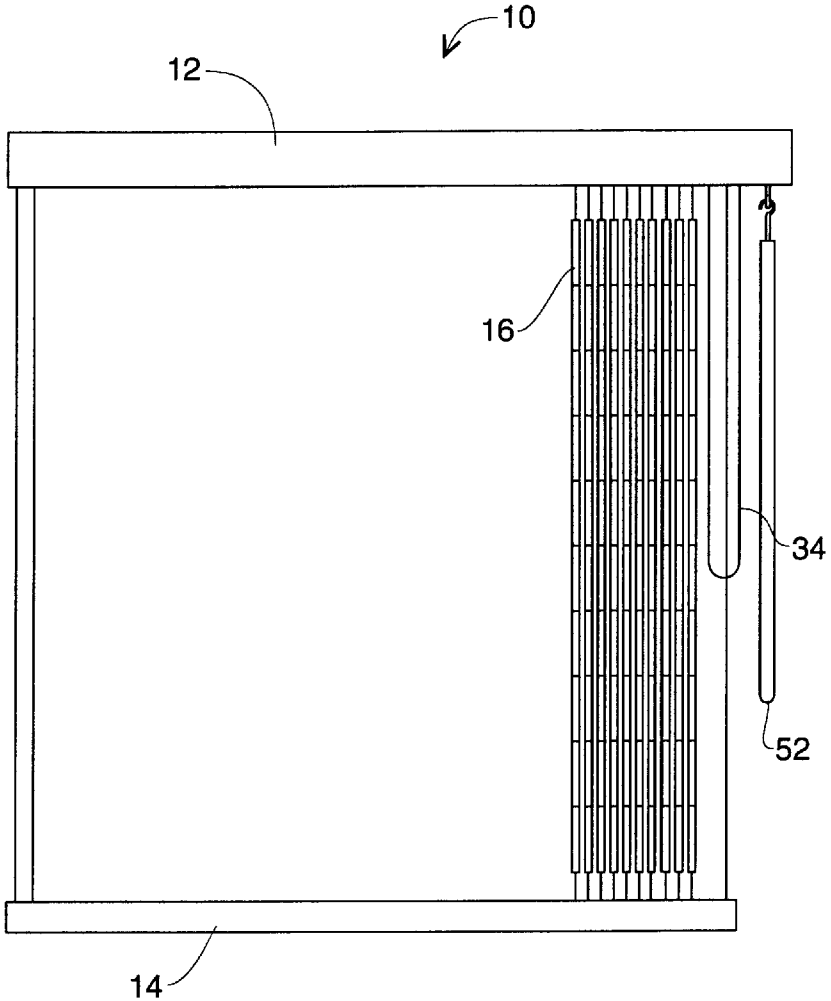
FIG. 12 is an elevational view of the window covering apparatus in the horizontally open position.

When the portion of the horizontal adjustment cord 74 which extends downward from the third horizontal adjustment pulley 66 is pulled downward, the leading first platform 42A and the leading second platform 46A move toward the remaining first and second platforms 42, 46, collapsing all of the first and second platforms 42, 46 together until the apparatus 10 reaches the horizontally open position shown elevationally in FIG. 12.

Referring to FIG. 2, a first horizontal pivot pulley 78 is connected to the stationary track assembly 12. The connection is not shown for case of illustration.

Referring to FIG. 3, a second horizontal pivot pulley 80 is connected to the stationary track assembly 12. The connection is not shown for ease of illustration.

Referring to FIG. 4, a third horizontal pivot pulley 82 is connected to the movable track assembly 14. The connection is not shown for ease of illustration.

Referring to FIG. 10, a fourth horizontal pivot pulley 84 is connected to the movable track assembly 14. The connection is not shown for ease of illustration.

Referring to FIGS. 2, 3, 4 and 10, a horizontal pivot cord 86 extends from the first horizontal pivot pulley 78, along the stationary track assembly 12, through first outer pivot arms 90 which are connected to the first spool members 38, to the second horizontal pivot pulley 80, then down to the fourth horizontal pivot pulley 84, then along the movable track assembly 14, through second inner pivot arms 96 which are connected to the second spool members 40, to the third horizontal pivot pulley 82, then up to the first horizontal pivot pulley 78.

The horizontal pivot cord 86 is fixedly connected to each first outer pivot arm 90 and to each second inner pivot arm 96. When the portion of the horizontal pivot cord 86 beneath the first horizontal pivot pulley 78 is pulled downward, the first outer pivot arms 94 are pivoted toward the first horizontal pivot pulley 78, and the second inner pivot arms 96 are pivoted toward the fourth horizontal pivot pulley 84, thus rotating the first and second spool members 38, 40 in a first direction.

When the portion of the horizontal pivot cord 86 beneath the first horizontal pivot pulley 78 is pulled upward, the first outer pivot arms 90 are pivoted toward the second horizontal pivot pulley 80 and the second outer pivot arms 94 are pivoted toward the third horizontal pivot pulley 82, thus rotating the first and second spool members 38, 40 in a second direction.

When the frame 56 is pivoted to a vertical position so that the panels 16 are oriented vertically as shown in FIG. 8, then the panels 16 may be rotated into the position shown in FIG. 11 by pulling the horizontal pivot cord 86 and causing the first and second spool members 38, 40 to rotate as described above.

A first tension cord 88 is strung between first inner pivot arms 92 which are connected to the first spool members 38. A second tension cord 89 is strung between second outer pivot arms 94 which are connected to the second spool members 40. The first and second tension cords 88, 89 assist in the rotation of the first and second spool members 38, 40 by pulling against adjacent pivot arms 92, 94 when the first outer pivot arms 90 and the second inner pivot arms 96 are pivoted as described above.

Figure 13:
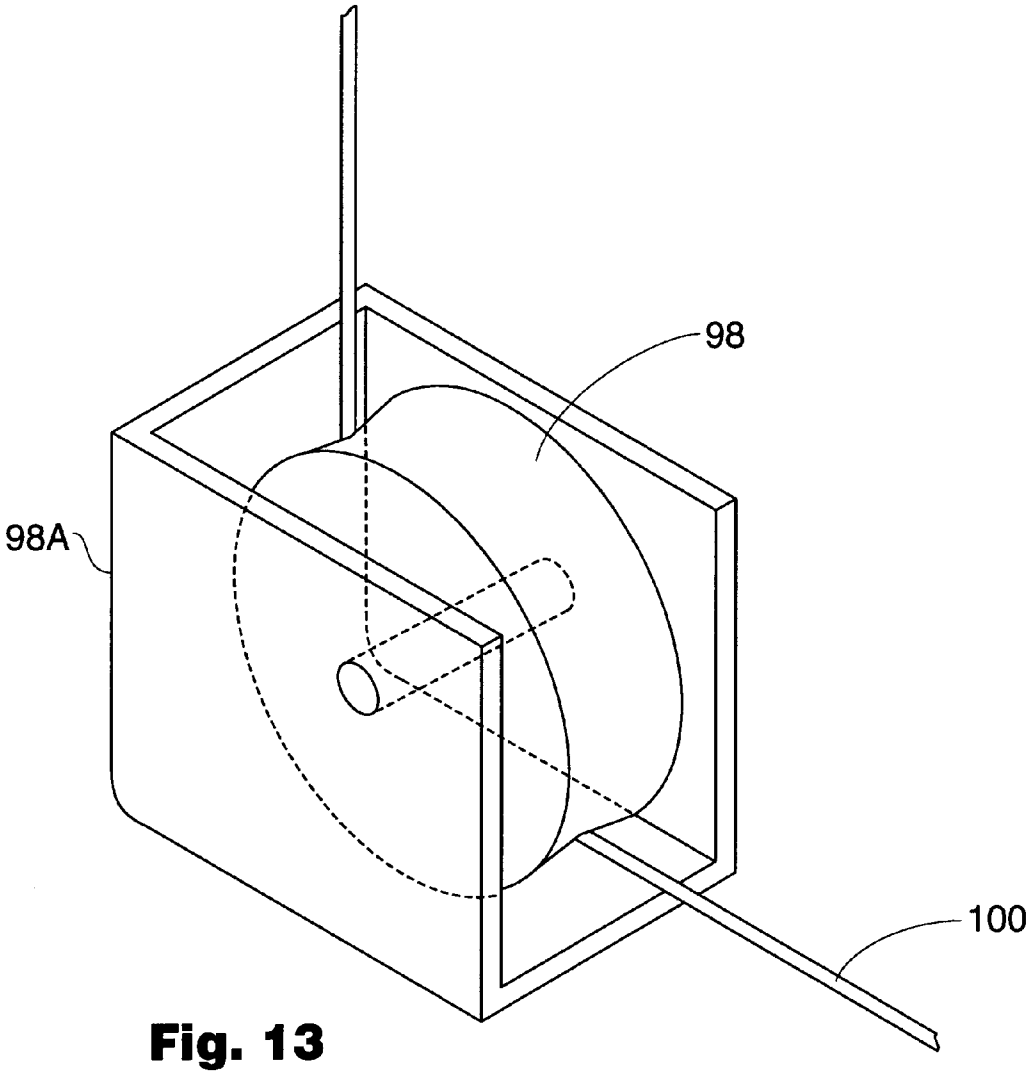
FIG. 13 is a perspective view of a pulley in a sleeve.

FIG. 13 is a perspective view of a pulley 98 in a sleeve 98A which is configured to maintain a cord 100 engaged on the pulley 98, even when slack is created in the cord 100. The sleeve 98A is preferably applied to all of the pulleys already described and shown. Sleeves have not been shown herein-before simply for clarity of illustration.

The foregoing description is included to describe embodiments of the present invention which include the preferred embodiment, and is not meant to limit the scope of the invention. From the foregoing description, many variations will be apparent to those skilled in the art that would be encompassed by the spirit and scope of the invention. Accordingly, the scope of the invention is to be limited only by the following claims and their legal equivalents.

The invention claimed is:

1. A window covering apparatus comprising:

a. a first track assembly adapted to be mounted to a top of a window opening;

b. a plurality of first cord support assemblies slidably mounted within the first track assembly;

c. a second track assembly;

d. a plurality of second cord support assemblies slidably mounted within the second track assembly;

e. a plurality of columns of panels, each column strung between a pair of the first and the second cord support assemblies;

f. a vertical opening and closing means for pulling the second track assembly toward the first track assembly and for lowering the second track assembly away from the first track assembly;

g. a horizontal opening and closing means for simultaneously drawing the first support assemblies together and drawing the second support assemblies together, and for simultaneously separating at pre-determined equal distances the first support assemblies and separating at pre-determined equal distances the second support assemblies;

h. a vertical pivoting means for pivoting all of the panels simultaneously about a horizontal axis of each panel; and i. a horizontal pivoting means for pivoting all of the panels simultaneously about a vertical axis of each panel.

2. A window covering apparatus comprising:

a. a first track assembly;

b. a second track assembly oriented substantially parallel to the first track assembly;

c. a plurality of columns of panels, each of the columns strung between the first track assembly and the second track assembly substantially at a right angle to the first and the second track assemblies;

d. a vertical opening and closing means for pulling the second track assembly toward the first track assembly and for lowering the second track assembly away from the first track assembly;

e. a horizontal opening and closing means for drawing the columns of panels together, and for separating the columns of panels at pre-determined equal distances;

f. a vertical pivoting means for pivoting all of the panels simultaneously about a horizontal axis of each panel; and g. a horizontal pivoting means for pivoting all of the panels simultaneously about a vertical axis of each panel.

* * * * *